US005975287A

United States Patent [19]

Negelen

[11] Patent Number: 5,975,287

[45] Date of Patent: Nov. 2, 1999

[54] BOTTLE CARRYING ARRANGEMENT

[75] Inventor: Emanuel Negelen, Schweich, Germany

[73] Assignee: Riverwood International Corporation, Atlanta, Ga.

[21] Appl. No.: 08/945,035

[22] PCT Filed: Feb. 12, 1997

[86] PCT No.: PCT/GB97/00375

§ 371 Date: Dec. 22, 1997

§ 102(e) Date: Dec. 22, 1997

[87] PCT Pub. No.: WO97/29973

PCT Pub. Date: Aug. 21, 1997

[30] Foreign Application Priority Data

Feb. 15, 1996 [GB] United Kingdom ..... 9603234

[51] Int. Cl.[6] ..... B65D 75/00

[52] U.S. Cl. ..... 206/168; 206/162; 206/427

[58] Field of Search ..... 206/139, 140, 206/162, 168, 427

[56] References Cited

FOREIGN PATENT DOCUMENTS 0 456 448 A2 11/1991 European Pat. Off. ..... B65D 71/40
2057360 5/1971 France ..... B65D 5/00

*Primary Examiner*—David T. Fidei
*Attorney, Agent, or Firm*—Womble Carlyle Sandridge & Rice, PLLC

[57] ABSTRACT

There is provided a paperboard device made from a blank (10) having two base panels (15, 16) for connection together, two side walls (20, 21), two top panels (22, 23), and two handle panels (24, 25) which are hingedly connected together by a fold (26). The top panels (22, 23) have apertures (28) for receiving necks of bottles to be retained by the device. The top panels also have flap sections (34), one of which has a tab (35) which, in use, extends through one of the apertures (28) in the other top panel (23) and is bent up and retained there by the neck of the bottle in that aperture.

11 Claims, 5 Drawing Sheets

BOTTLE CARRYING ARRANGEMENT

TECHNICAL FIELD

This invention relates to a paperboard arrangement for carrying bottles.

BACKGROUND OF THE INVENTION

Paperboard cartons for carrying bottles have been used in the packaging industry for some time. The various configurations of these cartons, however, have exhibited numerous problems and shortcomings, not the least of which has been the general lack of ease and comfort provided to persons lifting and carrying a carton filled with bottles. Other problems have related to the difficulty of assembling cartons around an array of bottles in a manner that is reliable and subject to efficient automation processes. It is to the provision of a paperboard carton that addresses these and other shortcomings that the present invention is primarily directed.

SUMMARY OF THE INVENTION

According to the present invention there is provided a paperboard carton for carrying a plurality of bottles arranged in two or more rows and each having a neck portion topped with a closure, said carton comprising oppositely disposed side walls, base walls hingedly connected to respective side walls and adapted to be secured relative to each other below the bottles, oppositely disposed top panels hingedly connected to the respective side walls and having apertures therein for receiving the neck portions of said bottles, handle panels hingedly connected to respective top panels and to each other and projecting upwardly from the top panels and a securing tab attached to one of said top panels and extending from said one top panel through one of the apertures on the other top panel and in use being held in position in said one aperture by the bottle in said one aperture.

Preferably the securing tab extends from a position adjacent an aperture in the first top panel such that this aperture, the tab and said one aperture in the other top panel are substantially aligned in the transverse direction of the carton.

In one embodiment, the aligned apertures are formed in flap sections of the respective top panels, each flap section being defined between two spaced cuts extending transversely on each lengthwise side of its associated aperture and also said flap portions are not directly connected to the handle panels.

It is a preferred feature that the cuts stop short of the hinge connections between the top panels and the side walls. Preferably the cuts are formed with frangible bridges at locations along their length. In a preferred arrangement the carton is for two rows of three bottles, the tab being associated with the apertures for the central pair of bottles.

With certain embodiments a further hinge extends the length of each panel between the hinge connection with the handle panel and the side wall. Also, a further interlock is provided between the two top panels, said further interlock connecting the two top panels before the retention of the tab by the bottle. Said retention is preferably by upward bending of the tab. Conveniently, the tab flares outwardly from where it joins said first top panel and the aperture in the other top panel has a narrowed top for receiving a narrow portion of the tab, ideally with a snap fit.

One embodiment of the present invention will now be described in more detail. The description makes reference to the accompanying diagrammatic drawings in which:

DETAILED DESCRIPTION OF THE PREFERRED EMBODIMENTS

Figure 1:
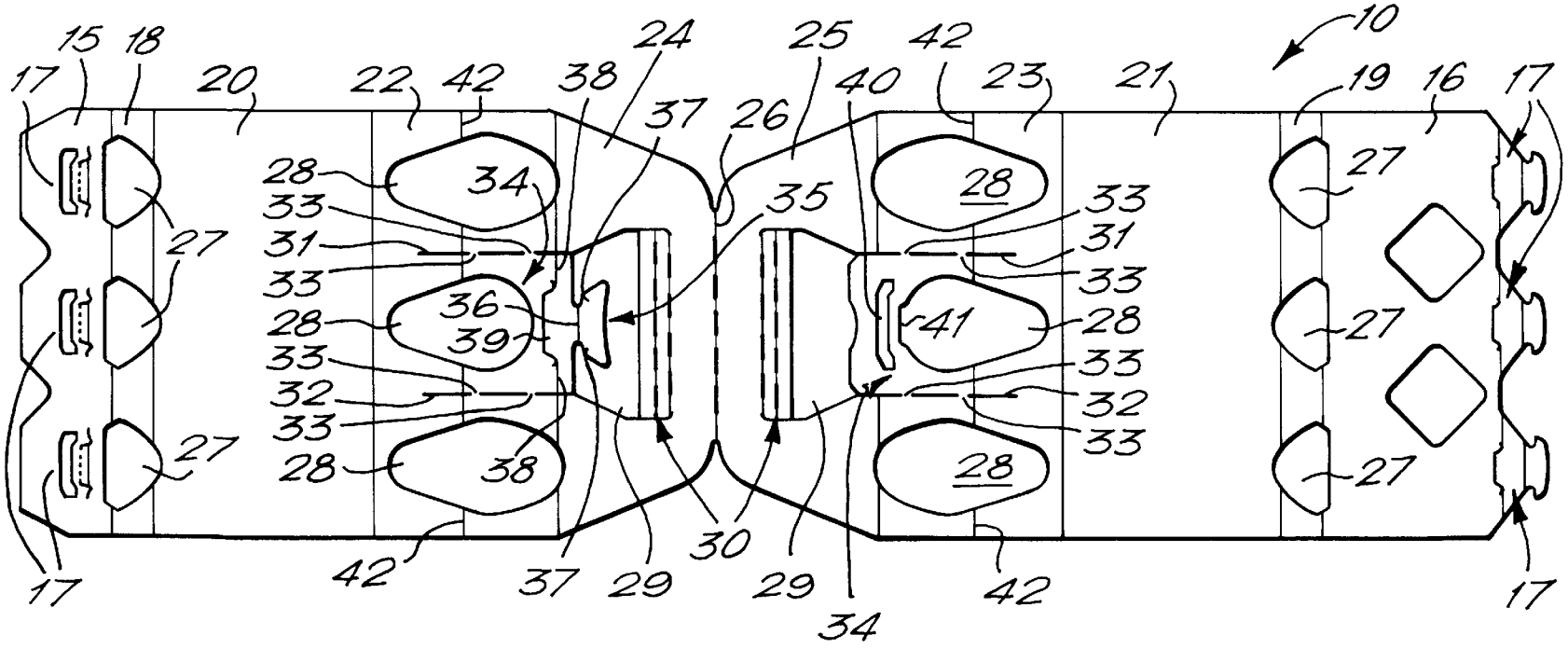
FIG. 1 shows a blank for producing a carton according to the present invention.
Figure 2:
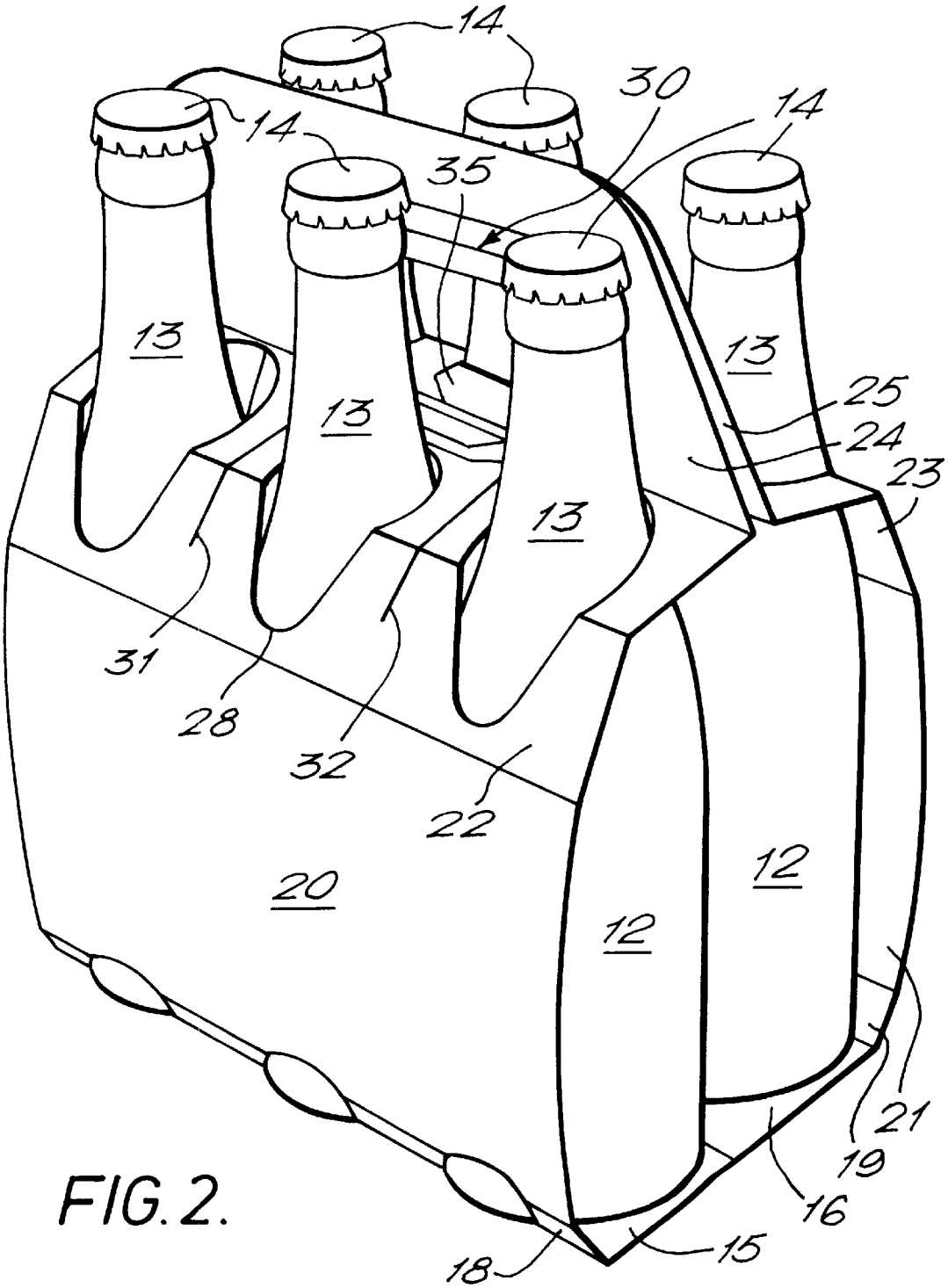
FIG. 2 is a perspective view from above of the carton in an initial position with the bottles shown in broken lines.
Figure 3:
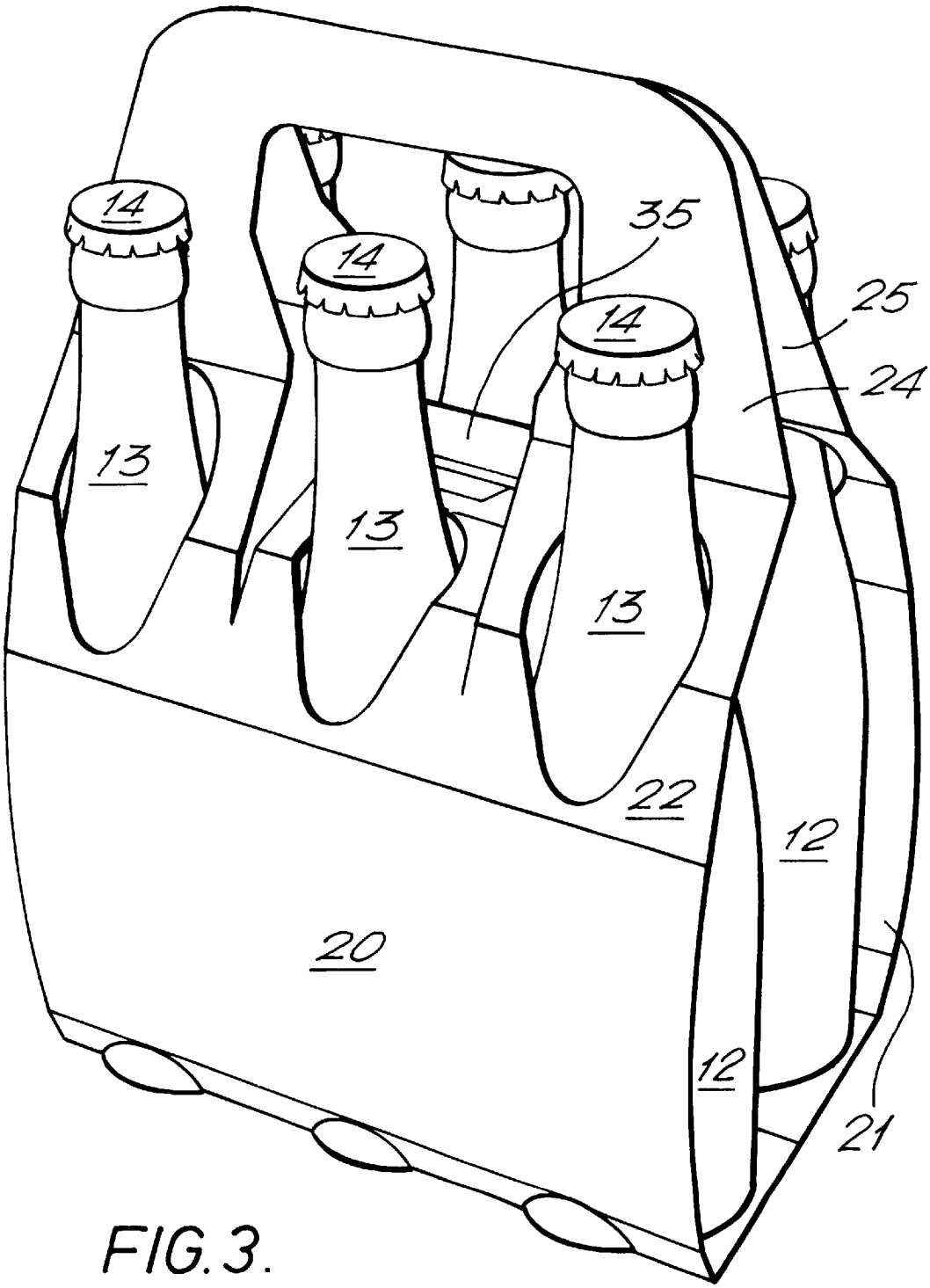
FIG. 3 is a perspective view from above of the carton after it has been lifted, again with the bottles shown in broken lines.

In the figures there is shown a blank 10 for producing a paperboard carton 11 for retaining a plurality of bottles 12 each having a neck portion 13 topped with a closure 14. In this particular embodiment the carton 11 is adapted to retain two rows of three bottles 12, but other arrangements will be apparent to the skilled reader.

The blank 10 has a pair of base panels 15, 16 each incorporating mating parts 17 of interlocking formations for joining the two base panels 15, 16. The base panels are hingedly connected to lower side walls 18, 19 which in turn are hingedly connected to side walls 20, 21 which in turn are hingedly connected to top panels 22, 23. The top panels 22, 23 are also hingedly connected to handle panels 24, 25 which are in turn hingedly connected to each other about a central fold 26.

Openings 27 are provided in the region of the base panels/lower side walls, side walls junction for receiving and retaining the heels of the bottles 12. Apertures 28 are also provided in the top panels 22, 23 for receiving the neck portions 13 of the bottles 12. Handle openings 29 are also provided in the handle panels 24, 25 for receiving the hand of the user. Cushion panels 30 remain hingedly connected to the handle panels 24, 25 to provide some comfort to the user.

A pair of cuts 31, 32 extend transversely into each top panel 22, 23, and also through part of the handle panels 24, 25, on either side of the central aperture 28. The cuts 31, 32 stop short of the fold connections between the top panels 22, 23 and the side walls. The cuts 31, 32 also have frangible bridges 33 at spaced locations along their lengths. These cuts 31, 32 and the handle openings 29 define flap sections 34 in which the central apertures 28 are located.

Extending from one of the flap sections 34 is a securing tab 35 which flares outwardly from the flap section 34, the connection having a narrow section 36. Adjacent the narrow section 36 the tab 35 has a pair of ears 37. Also in the flap section are a pair of folds 38 perpendicular to the cuts 31, 32 which folds 38 are linked by a generally channel shaped cut to form a lip 39.

The other flap section 34 is formed with a slot 40 and the central aperture 28 in this flap section has a straight sectioned narrow recess 41 at its top end. A further fold line 42 is also provided lengthwise of the top panels 22, 23.

Figure 4A:
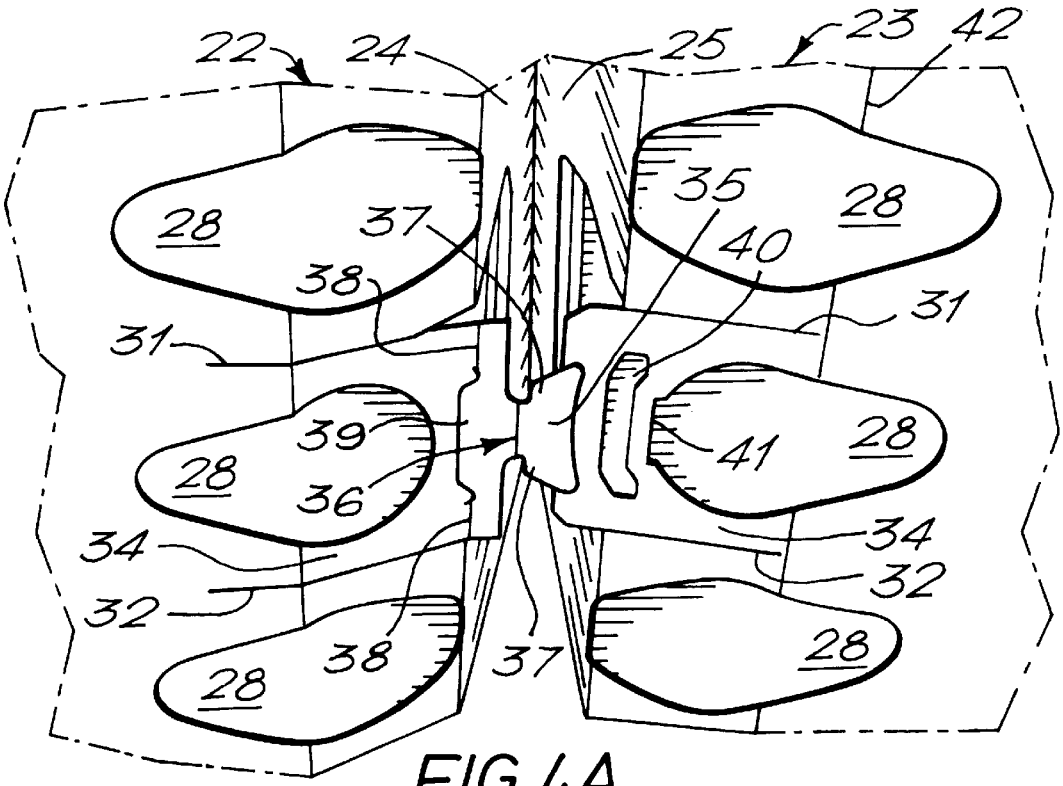
FIGS. 4A, 4B and 4C are perspective views from inside the carton showing the stages of connection of top panels of the carton.
Figure 4B:
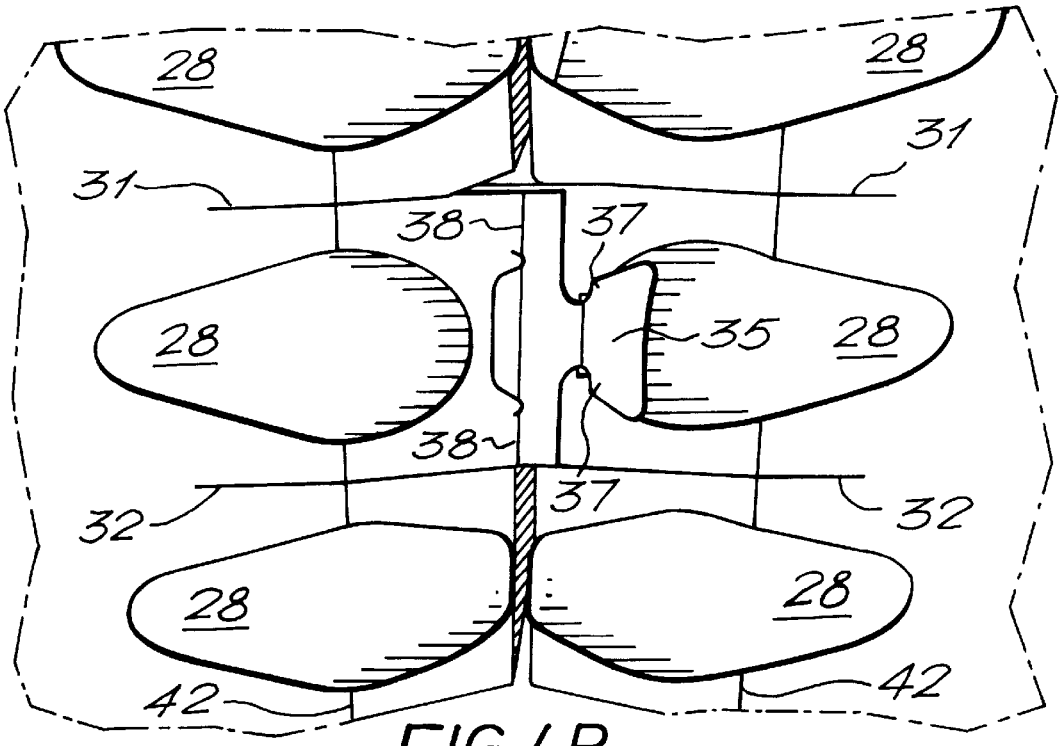
Figure 4C:
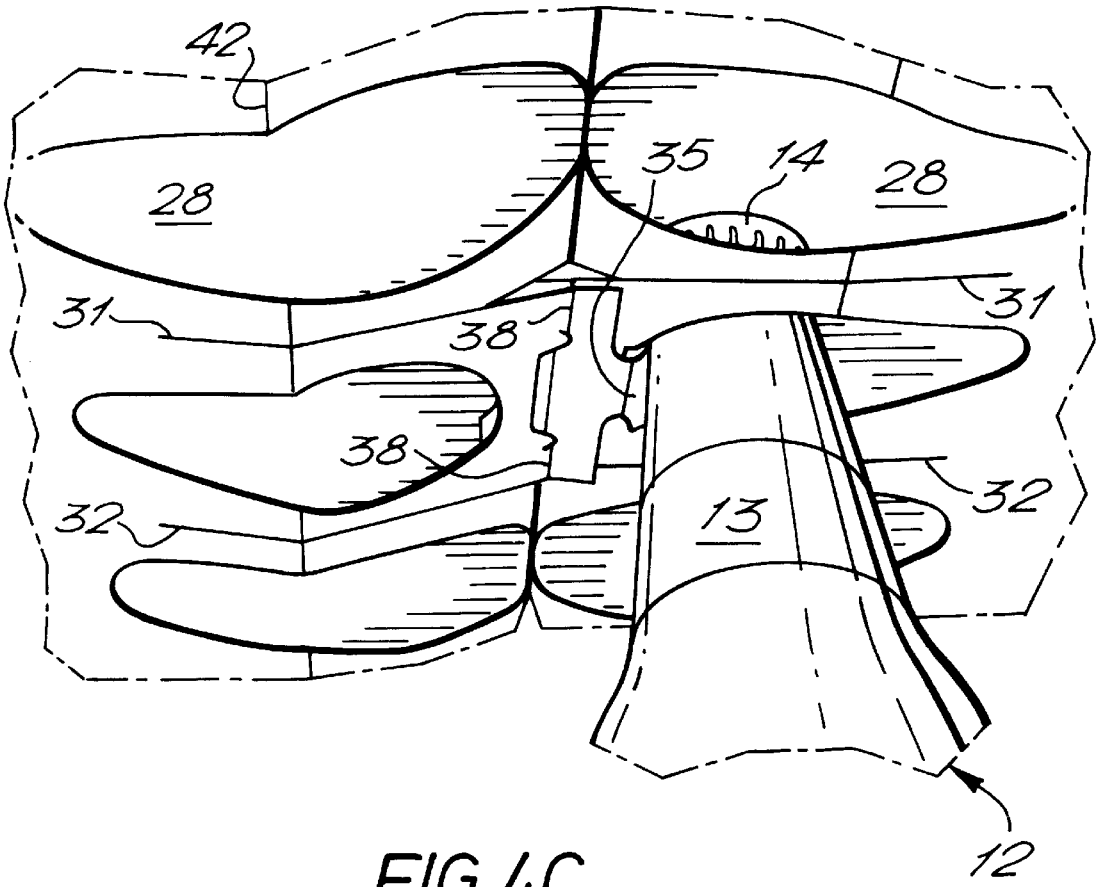

The assembly of the carton 11 will now be described and reference to FIGS. 4A, B and C will be of assistance.

The blank 10 is folded about its central fold 26 and the top panels 22, 23 are folded outwardly such that the tab 35 can pass below the other flap section 34. Folding about the folds 38 enables the lip 39 to engage in the slot 40 thereby to constitute an initial interlock with the tabs 35 partially blocking the aperture 28 in the other flap section 34.

The blank is then lowered over an assembled array of six bottles 12, the necks 13 of which pass through the apertures 28 in the top panels 22, 23. The tab 35 partially blocking one of the apertures is engaged by a bottle and is caused to hinge upwardly with the narrow section 36 engaging in the recess 41 in the aperture 28. The ears 37 on either side of the narrow section are preferably a snap fit past the edge of the aperture 35 immediately flanking the narrow recess 41. This causes a further interlock between the flap sections 35.

The remainder of the process involves the folding of the side walls, lower side walls and base panels around the array of bottles and the securing of the interlocking base panel formations 17 in a conventional manner. At this stage the top panels are slightly angled by virtue of the folds 42.

Also at this stage the frangible bridges 33 are still in tact and the two handle panels 24, 25 lie generally against each other. When a user picks the carton up, the weight of the bottles will cause the bridges 33 to break. This results in the handle panels separating somewhat whilst still being connected at the central fold 26, with the cushion panels 30 folding under the handle panels. The flap sections 34 clearly move out of the plane of their associated top panels 22, 23 and the angling at the folds 42 tends to disappear as the weight of the bottles is borne by the remaining parts of the top panels. The interlocked flap portions 34 prevent the handle panels 24, 25 from separating beyond a certain point. This partial separation of the handle panels 24, 25 makes the carton more comfortable to carry, but the carton remains a tight, secure unit before, during and after carrying.

It will be readily appreciated that further rows of bottles could be incorporated. In addition, if more bottles were provided in each row then further interlocking means could be provided between the top panels. Other methods of securing the base panels and retaining the bottle heels would also, of course, be possible.

While preferred embodiments of the invention have been disclosed in the foregoing specification, it is understood by those skilled in the art that variations, additions, and modifications thereof can be made without departing from the spirit and scope of the invention, as set forth in the following claims.

I claim:

1. A paperboard carton for carrying a plurality of bottles arranged in two or more rows and each having a neck portion topped with a closure, said carton comprising oppositely disposed side walls, base walls hingedly connected to respective ones of said side walls and adapted to be secured relative to each other below the bottles, oppositely disposed top panels hingedly connected to the respective ones of said side walls and having apertures therein for receiving the neck portions of bottles, said top panels including flap sections and said apertures are formed in said flap sections of the respective top panels, each said flap section being defined between two spaced cuts extending transversely on each lengthwise side of its associated aperture, handle panels hingedly connected to respective ones of said top panels and to each other and projecting upwardly from said top panels, and a securing tab attached one of said top panels and extending from said one of said top panels through one of said apertures on the other top panel and, in use, being held in position in said one of said apertures by the bottle in said one of said apertures.

2. A carton as claimed in claim 1 wherein said securing tab extends from a position adjacent an aperture in one of said top panels such that this aperture, the tab, and an aperture in the other one of said top panels are substantially aligned in the transverse direction of the carton.

3. A carton as claimed in claim 1 wherein said flap sections are not directly connected to said handle panels.

4. A paperboard carton for carrying a plurality of bottles arranged in two or more rows and each having a neck portion topped with a closure, said carton comprising oppositely disposed side walls, base walls hingedly connected to respective ones of said side walls and adapted to be secured relative to each other below the bottles, oppositely disposed top panels hingedly connected to the respective ones of said side walls and having apertures therein for receiving the neck portions of bottles, said top panels including flap sections and said apertures are formed in said flap sections of the respective top panels, each said flap section being defined between two spaced cuts extending transversely on each lengthwise side of its associated aperture and said side walls handle panels hingedly connected to respective ones of said top panels and to each other and projecting upwardly from said top panels, said cuts stopping short of said hinge connections between said top panels, and a securing tab attached one of said top panels and extending from said one of said top panels through one of said apertures on the other top panel and, in use, being held in position in said one of said apertures by the bottle in said one of said apertures.

5. A carton as claimed in claim 4 wherein said cuts are formed with frangible bridges at locations along their length.

6. A carton as claimed in claim 1 wherein said carton is for two rows of three bottles, said securing tab being associated with the apertures for the central pair of bottles.

7. A carton as claimed in claim 1 wherein a further hinge extends the length of each of said top panels between the hinge connection with said handle panel and said side wall.

8. A carton as claimed in claim 7 and further comprising an interlock provided between said top panels, said interlock connecting said top panels before the retention of said tab by the bottle.

9. A carton as claimed in claim 8 wherein said retention of said tab is provided by upward bending of the tab.

10. A carton as claimed in claim 9 wherein said tab flares outwardly from where it joins said top panel and said aperture in the other one of said top panels has a narrowed top for receiving a narrow portion of said tab.

11. A carton as claimed in claim 10 wherein said narrowed portion of said tab is received in said narrowed top in a snap fitting relationship.

* * * * *